United States Patent [19]

Takaoka et al.

[11] Patent Number: 4,571,453

[45] Date of Patent: Feb. 18, 1986

[54] CONDUCTOR FOR AN ELECTRICAL POWER CABLE

[75] Inventors: Michio Takaoka, Chiba; Tsuneaki Mohtai, Yachiyo; Syotaroh Yoshida; Kazuo Watanabe, both of Tokyo, all of Japan

[73] Assignee: The Fujikura Cable Works, Limited, Tokyo, Japan

[21] Appl. No.: 610,566

[22] Filed: May 15, 1984

Related U.S. Application Data

[63] Continuation-in-part of Ser. No. 490,986, May 9, 1983, abandoned.

[30] Foreign Application Priority Data

Nov. 9, 1978 [JP] Japan ..... 53-138066

[51] Int. Cl.[3] ..... H01B 3/10

[52] U.S. Cl. ..... 174/110 A; 174/108; 174/126 C

[58] Field of Search ..... 174/110 A, 108 R, 126 S, 174/126 C

[56] References Cited

U.S. PATENT DOCUMENTS

| | | | |
|---|---|---|---|
| 1,904,162 | 4/1933 | Milliken | 174/110 A |
| 1,995,356 | 3/1935 | Legg | 174/110 A |
| 2,115,777 | 5/1938 | Johnson | 174/110 A |
| 2,332,891 | 10/1943 | Clark | 174/126 C X |
| 3,107,107 | 10/1963 | Stein | 174/110 A |

FOREIGN PATENT DOCUMENTS

| | | | |
|---|---|---|---|
| 164519 | 9/1953 | Australia | 174/110 A |
| 80610 | 5/1982 | Japan . | |
| 287503 | 2/1929 | United Kingdom | 174/110 A |

*Primary Examiner*—R. R. Kucia

[57] ABSTRACT

In a method for manufacturing a stranded conductor for an electrical power cable comprising a process for forming cupric oxide films of from 0.3 μm to 3 μm in thickness by passing an uninsulated stranded conductor constituted by a plurality of stranded copper strands through oxidizing liquid, the stranded conductor passing through the liquid is curved in a wave to form gaps between the strands, and the oxidizing liquid is caused to penetrate between the strands through the gaps to form cupric oxide films of from 0.3 μm to 3 μm in thickness on the surfaces of the strands. Also disclosed is a stranded conductor for an electrical power cable constituted by a plurality of stranded copper strands, at least one of the copper strands being covered with a cupric oxide film free from exfoliation.

1 Claim, 12 Drawing Figures

CONDUCTOR FOR AN ELECTRICAL POWER CABLE

CROSS-REFERENCE TO THE RELATED APPLICATION

This application is a continuation-in-part application of U.S. Ser. No. 490,986 filed May 9, 1983, now abandoned.

BACKGROUND OF THE INVENTION

This invention relates to a conductor for an electrical power cable and, more specifically, to a large-size conductor for an electrical power cable and a method for manufacturing the same.

Accompanying the remarkable increase in electrical power consumption, the amount of power transmitted has been increasing steadily. With such an increase in power transmission capacity, large-size conductors for power cables have come into use. Recently, conductors with a cross-sectional area of more than 2,000 $mm^2$, especially, 5,000 to 6,000 $mm^2$, have been put to practical use.

These large-size conductors, however, are subject to a significant AC loss due to the skin effect. Namely, the increase of the AC resistance due to the skin effect suppresses the increase of the transmission capacity. In order to reduce such AC loss, so-called multi-segmental conductors have been developed. The multi-segmental conductor may be obtained by preparing a small-size segment formed of a shaped-stranded conductor, applying the insulation over the segment, and laying up several such small-size stranded segments into a large-size conductor. Also developed has been an insulating-film-coated stranded conductor in which each strand is covered with an insulating film.

FIG. 1 shows the skin effect coefficient characteristics of three conductors of different types with respect to the cross-sectional areas thereof. In FIG. 1, a characteristic curve A represents the case of an insulating-film-coated stranded conductor, while curves B and C represent cases of an oil-filled cable conductor and a pipe-type-oil-filled cable conductor, respectively. As is evident from FIG. 1, the insulating-film-coated stranded conductor is the lowest among the others in the coefficient of the skin effect for every cross-sectional area, and also in the increasing rate of the coefficient of the skin effect relative to the increase in the cross-sectional area of the conductor. Namely, the larger the cross-sectional area becomes, the more favorable the insulating-film-coated stranded conductor becomes as compared with the other types.

The enamel coating method has been generally used for the insulation of a strand. This enamel coating method, however, has the drawback of being expensive. Also available is a method of forming a surface oxide film on a strand by oxidizing the surface of every stand. In this method, each strand is individually immersed in oxidizing liquid to form an oxide film on the surface of the strand, for example. A plurality of such strands, each covered with an oxide film, are stranded to form a conductor for a cable. In this case, however, the strands already covered with the oxide films are stranded by means of an external force which causes a relatively large frictional force to occur between the strands in the course of stranding, thereby exfoliating the oxide films on the surfaces of the strands.

Furthermore, there is a method of immersing a stranded conductor in oxidizing liquid to oxidize the surface of each strand. In such a method, however, there is a drawback in that the strands are stranded tight at a stage where the conductor is immersed in the liquid, so that the oxidizing liquid will not be able to penetrate deep into the gap between the strands of the immersed conductor, thus oxidizing only the exposed surfaces of the strands at the superficial portions of the strands.

In addition to the coefficient of the skin effect, withstanding voltage and minimum ratio of winding are important factors for the conductor in an electrical power cable. Here, the withstanding voltage is the voltage over which the electrical insulation between two strands with surface insulation films in contact with each other is broken when the voltage is applied therebetween. The minimum ratio of winding is the ratio of the diameter of a mandrel to the diameter of the strand wound on the mandrel, over which the insulation film formed on the strand is exfoliated.

It is desirable for the conductor of an electrical power cable to have good characteristics in the coefficient of the skin effect, the withstanding voltage characteristic, and the minimum ratio of winding.

SUMMARY OF THE INVENTION

Accordingly, an object of this invention is to provide a low-cost conductor for an electrical power cable and, more specifically, a large-size conductor for large capacity having good characteristics in the skin effect coefficient, the withstanding voltage and the minimum winding ratio.

According to the invention, there is provided a stranded conductor for an electrical power cable constituted by a plurality of stranded copper strands, at least one of said strands being covered with a cupric oxide film having a thickness of from about 0.3 to about 3 $\mu m$, free from exfoliation, and formed by oxidizing said one strand and forming an insulating film for electrically insulating said one strand from the other strands.

According tb the invention, there is further provided a method for manufacturing a stranded conductor comprising steps of passing an uninsulated stranded conductor constituted by stranded uninsulated copper strands through oxidizing liquid while said stranded conductor is curved to form gaps between said strands, thereby forming cupric oxide films of from about 0.3 $\mu m$ to about 3 $\mu m$ in thickness on the surfaces of said strands, and removing said gaps between said strands.

DETAILED DESCRIPTION OF THE PREFERRED EMBODIMENTS

Figure 1:
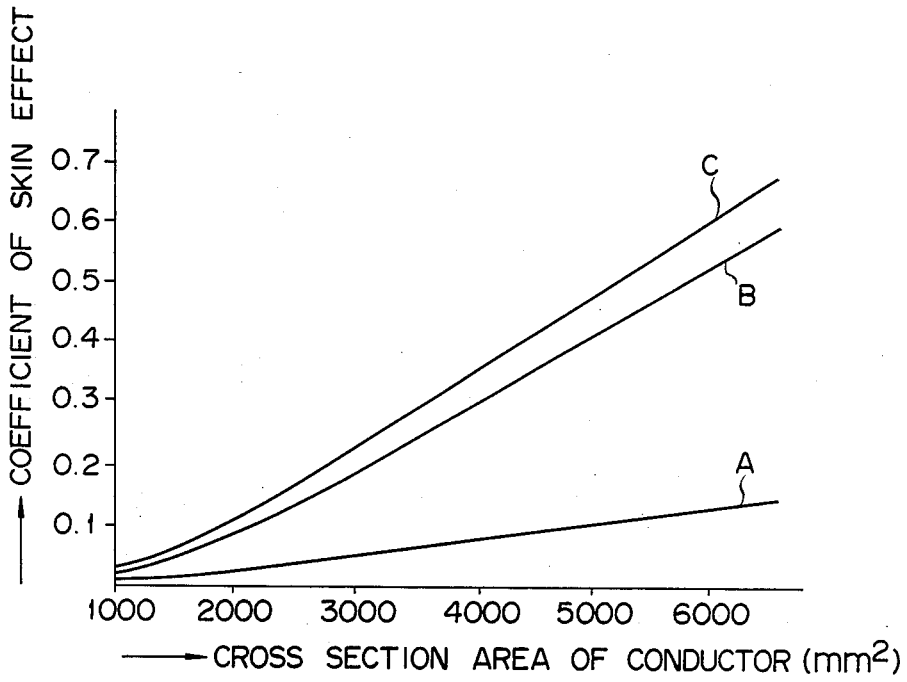
FIG. 1 shows the relationship between the cross-sectional areas of various conductors of different types and the coefficient of the skin effect.
Figure 2:
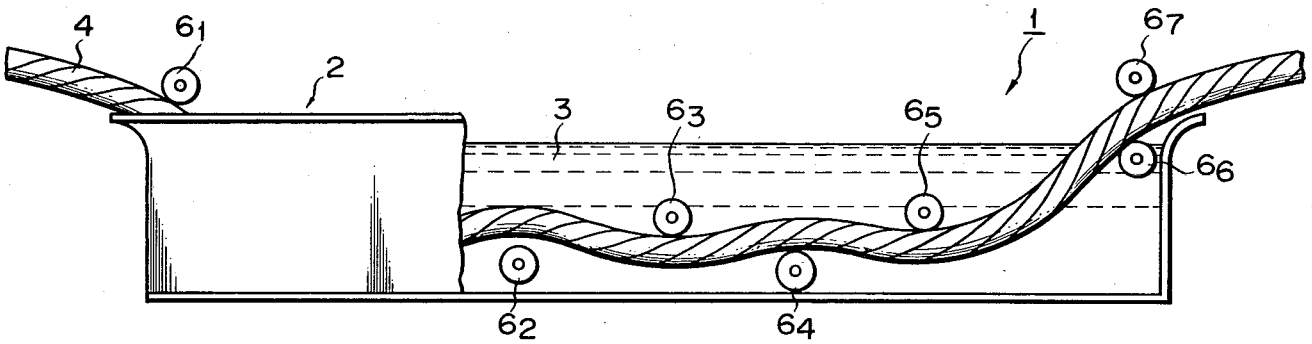
FIG. 2 shows the structure of an apparatus used in a process for executing the manufacturing method of this invention, and a process for illustrating the manufacturing method of a stranded copper conductor constituted by insulated copper strands with insulating cupric oxide films free from exfoliation.

In FIG. 2, there is shown a step in which the conductor, constituted by a plurality of stranded copper bear-strands, passes through oxidizing liquid, thereby forming a cupric oxide film on the surfaces of the copper strands constituting the conductor.

Besides the aforesaid surface oxidizing process, though including various processes of the conventional manufacturing method, for example, conductor paying-off, taking-up, rinsing and drying processes, the method for manufacturing the stranded conductor of this invention is specially characterized by the oxidizing process, and the other processes are to be executed in accordance with the conventional systems. Accordingly, FIG. 2 illustrates only the oxidizing process to simplify the drawing.

Figure 3:
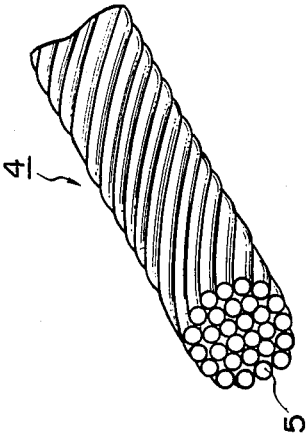
FIG. 3 is an enlarged perspective view of a stranded conductor to be subjected to an oxidation process as shown in FIG. 2.

In FIG. 2, numeral 1 designates an apparatus for the surface oxidation, in which a bath 2 is filled with oxidizing liquid 3. To facilitate the understanding of the construction of the apparatus, a wall member constituting the bath 2 is partially broken. Numeral 4 designates a conductor to be passed through the oxidizing liquid 3 for oxidation treatment. FIG. 3 shows an enlarged perspective view of part of the conductor.

Figure 4:
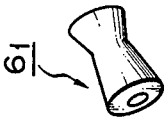
FIG. 4 is a perspective view of a guide roller.

As is evident from FIG. 3, the conductor 4 is constituted by a plurality of stranded copper strands 5. A guide roller $6_1$, which has its axial central portion constricted as perspectively shown in FIG. 4, is rotatably attached to a frame (not shown) of the apparatus at right angles to the running direction of the conductor 4. Guide rollers $6_2$, $6_3$, $6_4$, and $6_5$ are rotatably attached between two facing walls of the bath 2 at positions slightly vertically shifted from one another. The guide rollers $6_2$, $6_3$, $6_4$, and $6_5$ tend to cause the conductor 4 passing through the oxidizing liquid 3 in the bath 2 to meander up and down. Guide rollers $6_6$ and $6_7$ direct the conductor 4 from the liquid 3 toward the outside. Although not shown, a feed mechanism (e.g. feed roller) for feeding the conductor 4 and a take-up mechanism (e.g. taken-up roller) are disposed, as required, on the left and right sides of the apparatus of FIG. 2, respectively. The guide rollers $6_2$ to $6_7$ may be of the same construction as that of the guide roller $6_1$ as shown in FIG. 4.

Now there will be described the conductor manufacturing method of the invention employing the apparatus as shown in FIG. 2.

The conductor 4 is delivered from the feed mechanism (not shown) by the drive of the feed mechanism and take-up mechanism (not shown), and directed toward the oxidizing liquid 3 by the action of the guide roller $6_1$ to pass through the liquid 3. When advancing in the liquid 3, the conductor 4 is directed as illustrated through each of the guide rollers $6_2$ to $6_5$ located at varied heights, waving in the liquid 3. When the conductor 4 is curved by the guide rollers $6_2$ to $6_5$, narrow gaps are created between the strands 5 constituting the conductor 4. The oxidizing liquid 3 penetrates through these gaps, thus reaching inner strands as well as strands in the vicinity of the outer periphery of the conductor. Consequently, cupric oxide films are formed on the surfaces of not only the peripheral strands but also the inner ones. The oxidized conductor 4 is led to the outside by means of the guide rollers $6_6$ and $6_7$, washed in water and dried in conventional methods, and then wound on the take-up mechanism (not shown). Alternatively, the conductor after drying may be delivered as it is for a cutting process to cut the conductor into suitable lengths, without being wound. Although not absolutely required, the washing and drying processes are preferably executed.

The gaps created between the strands 5 due to the curving by the guide rollers $6_2$ to $6_5$ in the oxidizing process must be removed after the process. Since the guide rollers $6_2$ to $6_5$ in the bath 2 are arranged with relatively small differences in height, the gaps between the strands 5, caused by the guide rollers $6_2$ to $6_5$, are narrow. Therefore, those gaps between the strands 5 may be removed by applying a tensile force created by the conventional winding process. Thus, the gaps between the strands 5 are relatively small, so the removal of such gaps needs no great external force, only requiring the winding force applied to the conductor 4 in the winding process. The stress on the strands 5, therefore, is small, so that the cupric oxide film on the surface of each strand 5 will never exfoliate.

The conductor 4 has its own righting moment, whereby the gaps between the strands 5 can also be removed without utilizing the winding force in the winding process.

The oxidizing liquid 3 used should preferably be a mixed solution of 5% sodium chlorite and 5% sodium hydroxide.

In the manufacturing method, the conditions of the oxidation treatment are determined such that the cupric oxide films have about 0.3 to about 3 μm in thickness.

According to the manufacturing method of this invention, as described above, there may be provided the relatively inexpensive conductor 4 formed of the copper strands 5 with no exfoliated oxide film portion by delicately waving the conductor 4, passing through the oxidizing liquid 3, by means of the plurality of guide rollers $6_2$ to $6_5$ disposed with differences in height. This method causes the oxidizing liquid 3 to penetrate into the gaps between the strands 5 created by curving the conductor, thereby effectively forming cupric oxide films on the surface of the strands 5. the gaps are removed by the winding force applied to the conductor 4 in the winding process or by the righting moment of the conductor 4 itself where the winding process is not required.

Figure 5:
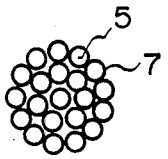
FIG. 5 is a cross-sectional view of the conductor after having undergone the oxidation process.
Figure 6:
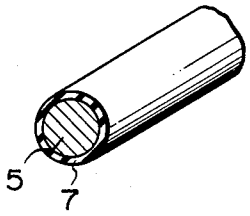
FIG. 6 is an enlarged perspective view of one of the strands of the conductor after having undergone the oxidation process.
Figure 7:
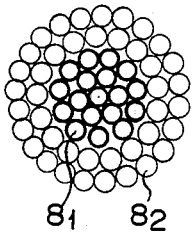
FIG. 7 is a cross-sectional view showing another form of the conductor provided by the manufacturing method of the invention.
Figure 8:
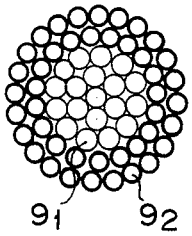
FIG. 8 is a cross-sectional view showing still another form of the conductor.

FIG. 5 shows a cross-sectional view of the conductor provided by the manufacturing method of the invention. As shown in FIG. 5, uniform and exfoliation-free cupric oxide films 7 (represented by circles described by thick lines in FIG. 5) are formed on the surfaces of all the copper strands 5, including the strands arranged in the inner part of the conductor as well as the strands on the outer periphery of the conductor. The conductor with such a structure will hardly be subject to the skin effect. The cupric oxide films formed by the manufacturing method, in which a bear stranded conductor passes through oxidizing liquid, of the invention have a high quality as compared with those formed by a method in which a bear stranded conductor passes through oxidizing gas. Moreover, according to the manufacturing method of the invention, the conductor obtained may be relatively inexpensive because of the cupric oxide films 7 formed on the individual copper strands 5 by oxidizing the surfaces thereof. FIG. 6 is an enlarged perspective view of one of the strands 5 of the conductor as shown in FIG. 5 to illustrate clearly the cupric oxide film 7 on the strand 5. It is unnecessary to apply the surface oxidation to all the strands 5 that constitute the stranded conductor 4. A double-layer conductor with only inner strands $8_1$ oxidized and outer strands $8_2$ unoxidized, as shown in FIG. 7, may be obtained by previously applying, for example, oil to the peripheral strands among the strands forming the conductor 4 before the execution of the oxidation process, thereby preventing the surface of such oiled strands from being oxidized in the oxidation process. In contrast with this, as shown in FIG. 8, the conductor obtained may have its inner strands $9_1$ unoxidized and outer strands $9_2$ oxidized.

Figure 9:
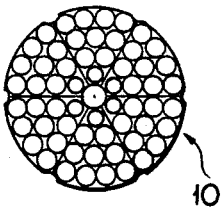
FIG. 9 is a cross-sectional view showing a further form of the conductor.
Figure 10:
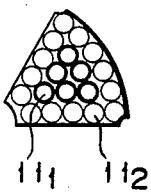
FIG. 10 is a cross-sectional view showing a form of a conductor segment constituting the conductor of FIG. 9.
Figure 11:
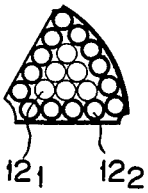
FIG. 11 is a cross-sectional view showing another type of the conductor segment as shown in FIG. 10.

Also, this invention may be applied to a segmental conductor consisting of a plurality of sector-shaped segments, as shown in FIG. 9. Such a conductor may be obtained by preparing segments 10 consisting of a plurality of stranded copper strands 5 according to the manufacturing method of this invention, and then stranding a plurality of such segments together. Although the segmental conductor shown in FIG. 9 is formed of six segments 10, it is to be understood that there may also be obtained a conductor consisting of four, five, eight, nine, ten, or twelve segments. The number of segments need not be limited to the number mentioned. Moreover, it is unnecessary to oxidize all the strands that constitute each segment; strands at only a specified portion are to be oxidated for insulation, like in the case of FIG. 7 or 8. A segment shown in FIG. 10 has its inner strands $11_1$ insulated and peripheral strands $11_2$ uninsulated. In contrast with this, FIG. 11 shows a conductor segment with inner strands $12_1$ uninsulated and peripheral strands $12_2$ insulated.

It is to be understood that the strands may be stranded in alternate directions or in one and the same direction.

Figure 12:
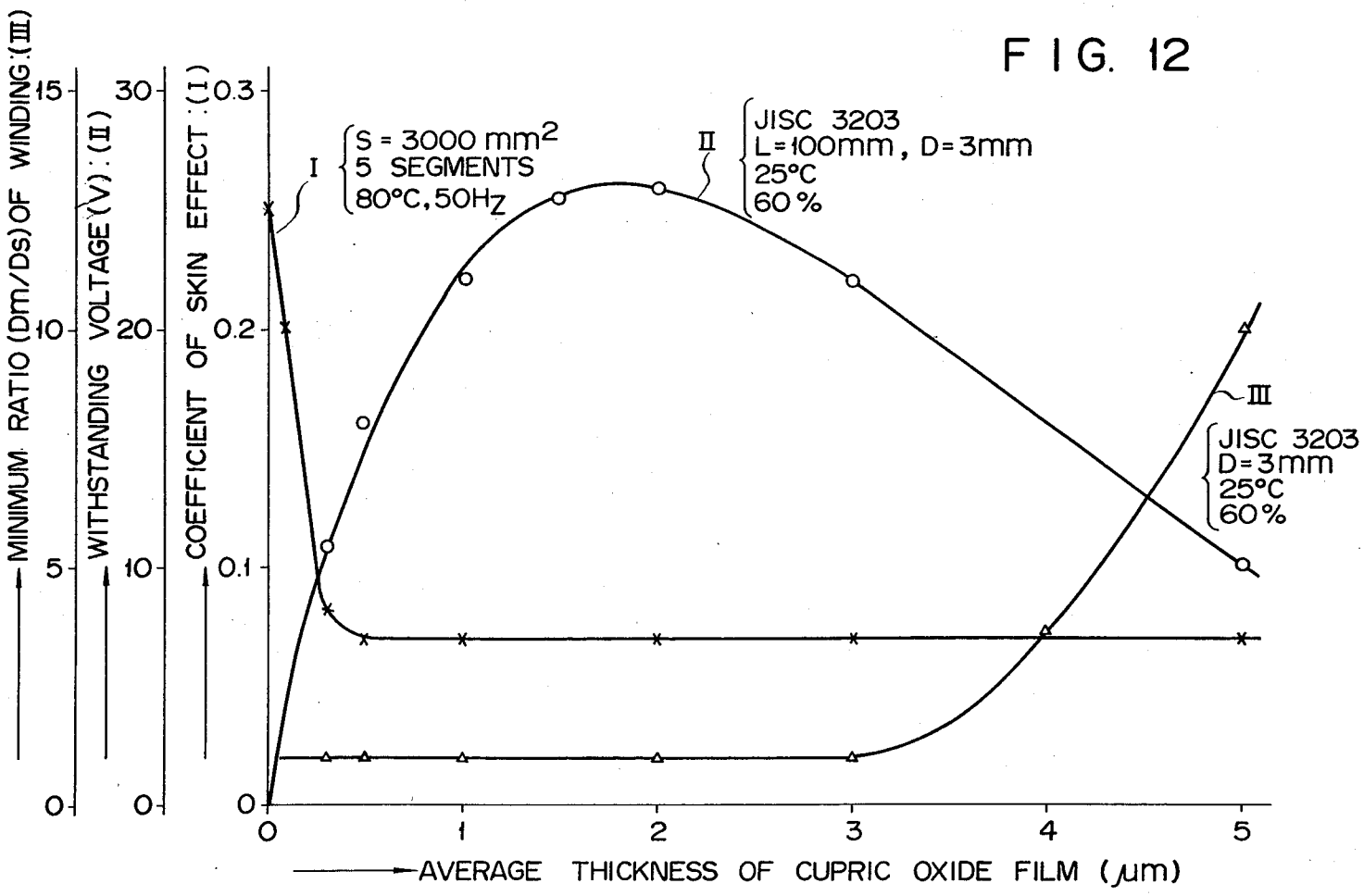
FIG. 12 shows various characteristic curves of the strand and the conductor of the invention.

Some tests were made on the strands and the conductors obtained by the manufacturing method of the invention. The results are shown in FIG. 12. In FIG. 12, the average thickness (μm) of the insulation film (cupric oxide film) is plotted on the abscissa. On the ordinate are plotted the coefficients of the skin effect, withstanding voltage (V), and minimum ratio of winding (Dm/Ds). The withstanding voltage is the voltage over which the electrical insulation between two strands with cupric oxide films in contact with each other is broken when the voltage is applied therebetween. The minimum ratio of winding is the ratio of the diameter Dm of a cylindrical mandrel to the diameter Ds of the strand wound on the mandrel, over which the cupric oxide film formed on the strand is exfoliated. In FIG. 12, curve I shows a characteristic curve of the coefficient of the skin effect, curve II shows a characteristic curve of the withstanding voltage, and curve III shows a characteristic curve of the minimum ratio of winding. The characteristic curve I of the coefficient of the skin effect was obtained by the test using a conductor of 3,000 $mm^2$ in the cross-sectional area and a 5 segment type. The temperature of the conductor was set to 80° C. The frequency of the voltage applied to the conductor was set to 50 Hz. The test, with regard to the characteristic curve II of the withstanding votlage, was carried out according to JIS-C 3203. In the test of the curve II, strands were used which were 100 mm in length (L) and 3 mm in diameter (D) and rubbed reciprocally at the cupric oxide films by a needle 5 times along the longitudinal direction of the strands to estimate the degree of wear of the cupric oxide film. Generally, when installed the stranded conductor is wound on a drum and in an actual use is subject to a heat cycle in which the strands are expanded under a heavy load and shrinked under a light load. In this time, a frictional force occurs between the strands to cause the cupric oxide film to be worn. This is because the strand used in the test were rubbed at the cupric oxide film by the needle. The cupric oxide film, when rubbed reciprocally 5 times by the needle, may have substantially the same degree of wear as those of the strand actually used. The temperature and humidity were set to 25° C. and 60%, respectively. The characteristic curve III of the minimum winding ratio was carried out according to JIS-C 3203. The curve III of the ratio was obtained by a test using a strand of 3 mm in diameter. The temperature and humidity were set to 25° C. and 60%, respectively.

As seen in FIG. 12, the curve I of the skin effect coefficient is substantially constant to about 0.07 when the insulation film has a thickness of about 0.3 μm or more. The curve II of the withstanding voltage has a peak where the cupric oxide film has about 1.5 to 2.0 μm in thickness. When the cupric oxide film has about 0.3 μm or more in thickness, the withstanding voltage is higher than 10 (V) and sufficiently large. The strand is generally required to have a withstanding voltage of 10 V or more for practical use. The curve III of the minimum winding ratio has a constant value of 1 when the strand has a thickness less than 3 μm. When the thickness of the strand is more than about 3 μm, the ratio increases. From the above, the average thickness of the cupric oxide film should be set from about 0.3 μm to about 3 μm. This range of the average thickness is preferable even when aging of the conductor in practical use is taken into consideration.

What is claimed is:

1. A stranded conductor for an electrical power cable constituted by a plurality of stranded cooper strands, at least one of said strands being covered with a cupric oxide film having a thickness of from about 0.3 to about 3 μm, free from exfoliation, and formed by oxidizing said one strand and forming an insulating film for electrically insulating said one strand from the other strands.

* * * * *